US009171431B2

(12) United States Patent
Kayani

(10) Patent No.: US 9,171,431 B2
(45) Date of Patent: Oct. 27, 2015

(54) NOTE FEEDER FOR A BANK NOTE PROCESSING MACHINE

(75) Inventor: Sohail Kayani, Irving, TX (US)

(73) Assignee: Toshiba International Corporation, Houston, TX (US)

( * ) Notice: Subject to any disclaimer, the term of this patent is extended or adjusted under 35 U.S.C. 154(b) by 0 days.

(21) Appl. No.: 14/110,623

(22) PCT Filed: Apr. 15, 2011

(86) PCT No.: PCT/US2011/032717

§ 371 (c)(1),
(2), (4) Date: Jan. 6, 2014

(87) PCT Pub. No.: WO2012/141719

PCT Pub. Date: Oct. 18, 2012

(65) Prior Publication Data

US 2014/0306398 A1 Oct. 16, 2014

(51) Int. Cl.
*B65H 1/26* (2006.01)
*G07F 19/00* (2006.01)

(52) U.S. Cl.
CPC ..... *G07F 19/202* (2013.01); *B65H 1/263* (2013.01); *B65H 2701/1912* (2013.01)

(58) Field of Classification Search
CPC ..... B65H 1/20; B65H 1/26; B65H 1/263; B65H 1/30; B65H 7/02; B65H 2301/42346; B65H 2405/351; B65H 2405/36; B65H 2405/361
USPC ..... 271/9.01, 9.02, 9.03, 9.05, 9.07, 9.08, 271/9.12, 9.1, 147, 157; 414/795.8, 796.7, 414/790.8, 790, 791.1, 791, 789.9, 792.8, 414/793.4–794.3; 101/484, 485, 232
See application file for complete search history.

(56) References Cited

U.S. PATENT DOCUMENTS 3,477,324 A * 11/1969 Schwebel ..... 83/79
5,558,489 A 9/1996 Moncrief et al.

(Continued)

FOREIGN PATENT DOCUMENTS

JP 57077134 A 5/1982
JP H05-254675 A 10/1993
JP 2004-231234 A 8/2004

OTHER PUBLICATIONS

International Preliminary Report on Patentability, International Application No. PCT/US2011/032717, mailed Oct. 24, 2013, 5 pages.

(Continued)

*Primary Examiner* — Thomas Morrison
(74) *Attorney, Agent, or Firm* — Baker Botts L.L.P.

(57) ABSTRACT

An apparatus and method for feeding documents within a document processing machine. The feeder apparatus includes a first feeder paddle and a second feeder paddle, each capable of linear translatory motion within the document feed path, the first paddle being outwardly displaceable with respect to the document feed path, each paddle having a document support surface and a plurality of cutout features along the document surface that allow either paddle to singularly support the document stack, and that allow both the first and second paddle document surfaces to simultaneously occupy a common level plane within the document feed path. The method uses a first feeder paddle to feed a first stack of documents and a second feeder paddle to add a second stack of documents to the first stack without interrupting the feeding of the first stack, and using the first feeder paddle to feed the combined stack of documents.

11 Claims, 10 Drawing Sheets

(56) References Cited

U.S. PATENT DOCUMENTS

| | | | | |
|---|---|---|---|---|
| 5,871,209 | A | 2/1999 | Orchard et al. | |
| 6,123,329 | A * | 9/2000 | Sato et al. | 271/9.01 |
| 6,398,000 | B1 | 6/2002 | Jenrick et al. | |
| 7,748,702 | B2 * | 7/2010 | Auer et al. | 271/159 |
| 2003/0052444 | A1 | 3/2003 | Luebben et al. | |
| 2007/0023989 | A1 * | 2/2007 | Dopfer et al. | 271/10.01 |

OTHER PUBLICATIONS

International Search Report and Written Opinion, International Application No. PCT/US2011/032717, 9 pgs., Jan. 10, 2012.

Decision of Rejection in related Japanese Patent Application No. 2014-505116, mailed on Jul. 13, 2015 (7 pages with translation).

* cited by examiner

NOTE FEEDER FOR A BANK NOTE PROCESSING MACHINE

CROSS-REFERENCE TO RELATED APPLICATION

This application is a U.S. National Stage Application of International Application No. PCT/US2011/032717 filed Apr. 15, 2011, and which is hereby incorporated by reference in its entirety.

BACKGROUND OF THE INVENTION

1. Field of the Invention

The present invention relates to document processing machines and, more specifically, to a paper currency feeder mechanism for a bank note processing machine.

2. Description of Related Art Including Information Disclosed Under 37 CFR 1.97 and 1.98

Typical document processing machines feature a document feed path into which a stack of documents to be processed is placed. A stripping device strips documents from the stack one at a time and passes the stripped document into a document path inlet for subsequent detection, sorting, and the like. For proper stripping operation, adequate pressure must be maintained between the stripping device and the document stack.

In a gravity-feed arrangement, the document stack is placed upon the stripper device. Initially the weight of the document stack provides sufficient pressure to allow the document stripper to function properly. However, as the document stack is depleted the weight of the document stack decreases causing a reduction in the pressure felt between the stripper and the documents. A reduction in pressure causes the stripping device to slip unless its action is slowed. Consequently, the stripping action is diminished and the document throughput is adversely affected.

In an essentially vertical feed arrangement, a feeder paddle is utilized to overcome the effects of gravity and to maintain a relatively consistent pressure between the document stack and the stripper device. In this arrangement the documents are placed upon a feeder paddle which raises the documents until the top of the stack contacts the stripper device. The stripper then removes documents one by one from the top of the stack and feeds them sequentially into the document path inlet of the processing machine for subsequent processing. As documents are stripped from the stack, the feeder paddle must raise to compensate for the decreasing height of the stack and to maintain sufficient pressure against the stripper mechanism. Thus, stripper action is relatively consistent regardless of the stack size because of the pressure exerted by the feeder paddle upon the stack.

Document throughput in a document processing device depends upon the speed at which documents can be fed into the note path. With the vertical feed arrangement the stripper action and corresponding throughput can be optimized based upon the relatively consistent pressure applied by the feeder paddle. As the document stack is processed the throughput remains optimal. However, when the stack is depleted throughput drops as another document stack is loaded into the feed path. Thus, even existing vertical document feeder devices encounter periods during which throughput is adversely affected. Accordingly, a need exists for a document feeder apparatus that allows optimal document feed pressures even during document reloading in order to optimize document throughput in the processing machine.

BRIEF SUMMARY OF THE INVENTION

The present invention provides a feeder apparatus, the apparatus comprising: a first feeder paddle and a second feeder paddle capable of linear translatory motion within a document feed path of a document processing machine, the first feeder paddle being further outwardly displaceable with respect to the document feed path, each paddle having a document surface for supporting a stack of documents as the documents are translated within the document feed path; and a plurality of cutout features along the document surface that allow either the first feeder paddle document surface or the second feeder paddle document surface to singularly support the stack of documents, and that allow both the first and second feeder paddle document surfaces to simultaneously occupy a common level plane within the document feed path.

The present invention also provides a method for feeding documents into the document feed path of a document processing machine, the method steps comprising: using a first feeder paddle having a document surface for supporting a stack of documents to feed a first stack of documents within a document path of a document processing machine; using a second feeder paddle having a document surface for supporting a stack of documents to add a second stack of documents to the first stack of documents without interrupting the feeding of the first stack of documents, wherein the combined first stack of documents and the second stack of documents become a contiguous third stack of documents; and using the first feeder paddle to feed the third stack of documents within the documents path.

BRIEF DESCRIPTION OF THE SEVERAL VIEWS OF THE DRAWING(S)

The present invention will be more fully understood by reference to the following detailed description of the preferred embodiments of the present invention when read in conjunction with the accompanying drawings, wherein.

Figure 1:
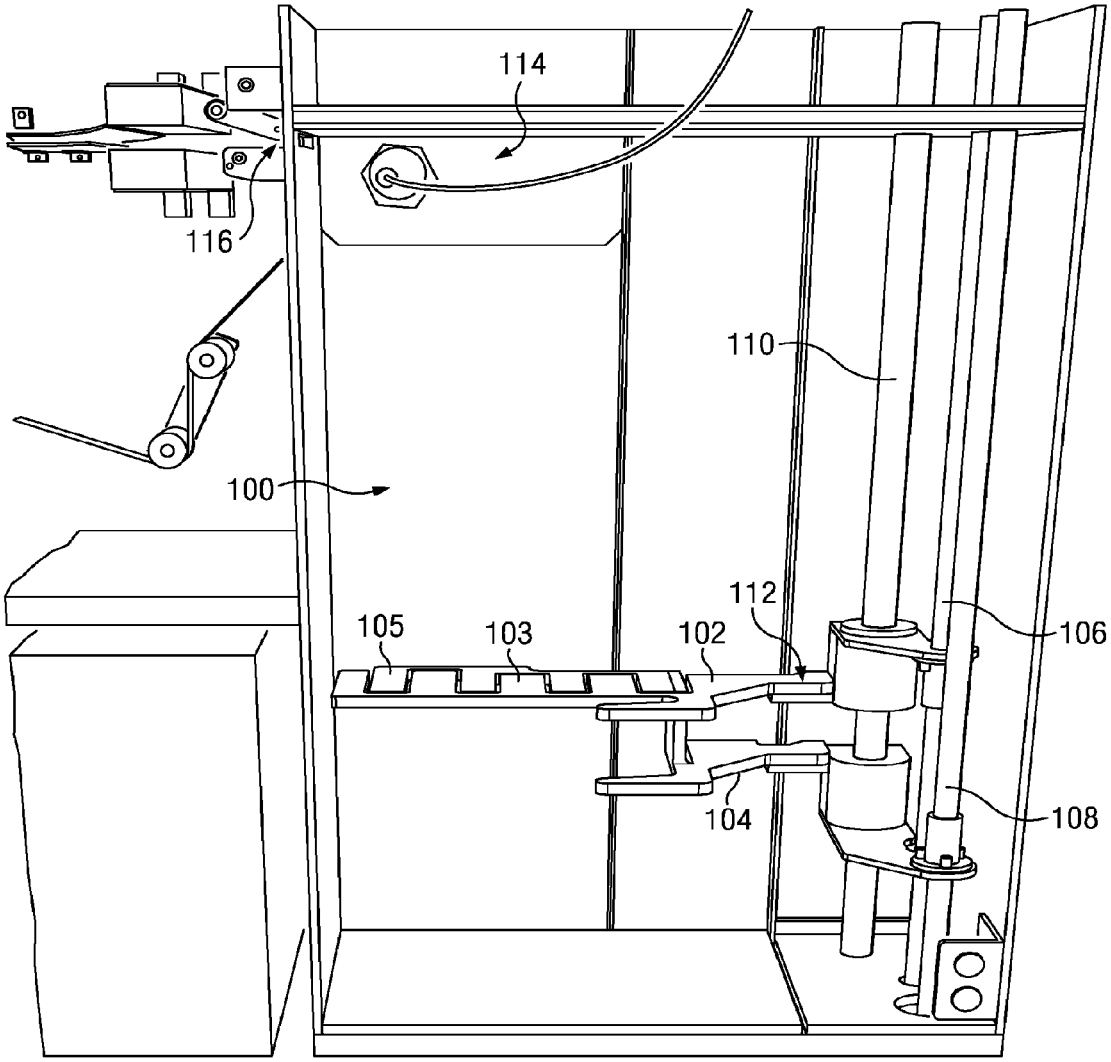
FIG. 1 is a depiction of the document feed path of a document processing machine utilizing an embodiment of the present invention as discussed herein.

The above figures are provided for the purpose of illustration and description only, and are not intended to define the limits of the disclosed invention. Use of the same reference number in multiple figures is intended to designate the same or similar parts. Furthermore, when the terms "top," "bottom," "first," "second," "upper," "lower," "height," "width," "length," "end," "side," "horizontal," "vertical," and similar terms are used herein, it should be understood that these terms have reference only to the structure shown in the drawing and are utilized only to facilitate describing the particular embodiment. The extension of the figures with respect to number, position, relationship, and dimensions of the parts to form the preferred embodiment will be explained or will be within the skill of the art after the following teachings of the present invention have been read and understood.

DETAILED DESCRIPTION OF THE INVENTION

FIG. 1 depicts a first embodiment of the present invention. In this figure, the vertical document feed path (100) and document note path inlet (116) are shown. The document stripper mechanism (114) resides at the entrance of the note path inlet (116). A first feeder paddle (102) and a second feeder paddle (104) are shown with the respective document surfaces (103 and 105) aligned and occupying a common level plane within the document feeder path (100).

The first feeder paddle (102) and second feeder paddle (104) in this embodiment share a common vertical guide shaft (110). This guide shaft (110) is positioned proximate the feed path (100) to align the paddles (102 and 104) and to allow translation of the paddles within the feed path in a linear fashion. The first feeder paddle (102) also incorporates a hinged portion (112) that allows the paddle to be rotated about an axis parallel to the guide shaft (110). This rotation allows the paddle (102) move outward from the feed path (100). In yet another embodiment the paddle (102) rotates around the axis of the guide shaft (110).

The first and second paddles (102 and 104) are coupled to separate rotary-to-translatory mechanical linkage devices (106 and 108, respectively). In this embodiment the rotary-to-translatory mechanical linkage device includes a lead screw assembly which converts lead screw shaft rotation into linear translation of the coupled paddle. Other embodiments may utilize other rotary-to-translatory devices such as, but not limited to, a ball screw device, a rack-and-pinion device; a belt and pulley device; a chain and sprocket device; a slider crank device; or some other combination that allows for translatory movement of the feeder paddles (102 and 104) within the feed path (100). In yet another embodiment the paddles share a single lead screw, with each paddle having a dedicated drive nut that provides the motive force. This single lead screw may be stationary, or may be rotatable to provide positioning of both paddles simultaneously.

Figure 2:
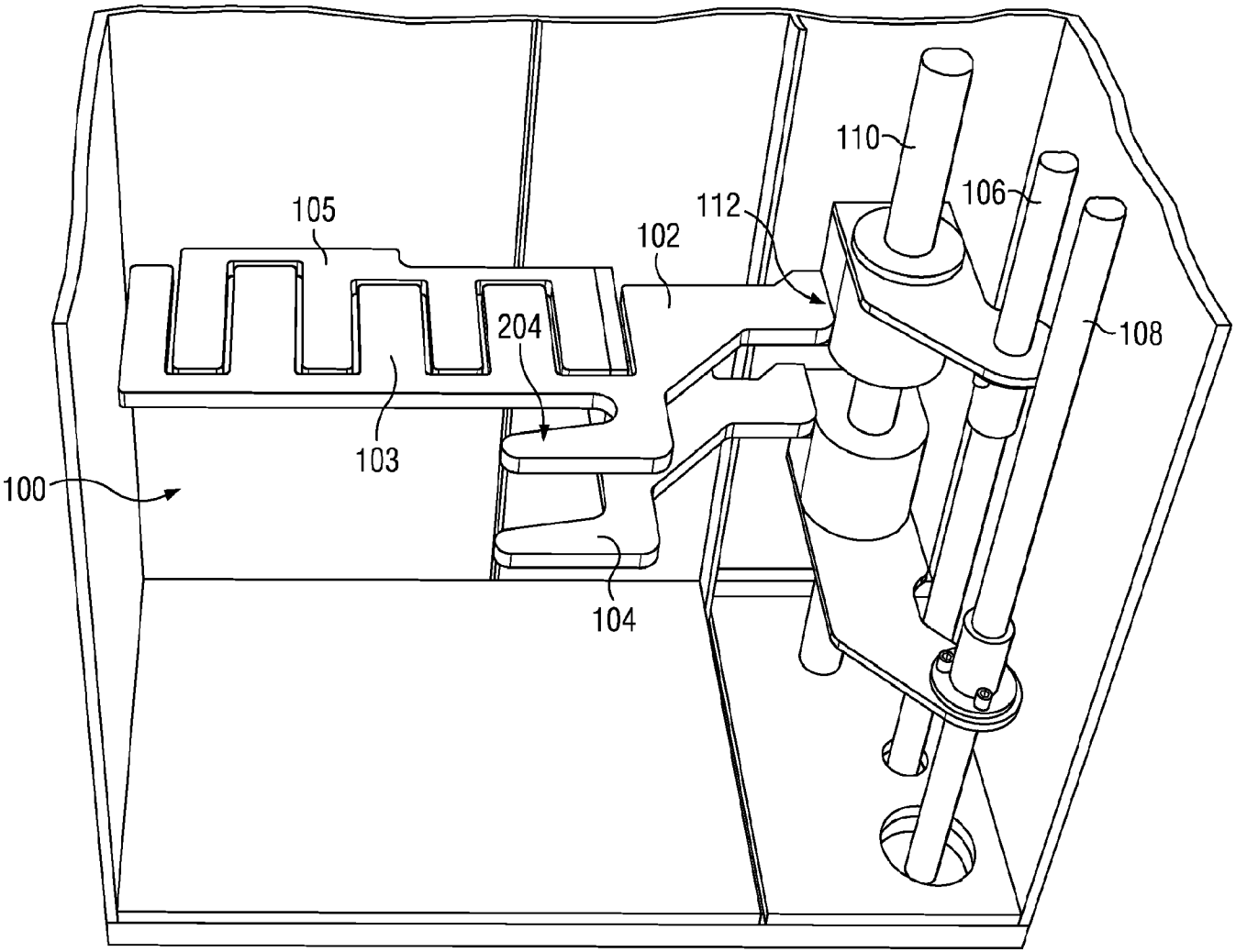
FIG. 2 is a downward view depiction of the embodiment with the feeder paddles positioned such that the document surfaces occupy a common level plane within the feed path.

FIG. 2 depicts a downward view of the first embodiment with the feeder paddles positioned such that the document surfaces occupy a common level plane within the feed path. The document surface (103) of the first paddle (102) and the document surface (105) of the second paddle (104) are more clearly shown, highlighting the cutout features. In this embodiment the cutout features are rectangular extensions originating from a common edge of a feeder paddle. Both paddles (102 and 104) utilize complimentary cutout features, allowing the document surface of both paddles to occupy a common level plane within the document feeder path (100). The rectangular extensions are also long enough to allow either paddle, singularly, to support the stack of documents placed thereon. Although a rectangular extension is utilized in this embodiment, it is possible to utilize other shapes—such as but not limited to triangular cutouts, rounded cutouts or other shape or combination of shapes—so long as the document surface of both paddles to occupy a common level plane within the document feeder path (100) and each paddle is capable to support the stack of documents placed thereon. Also visible is the handle (204) by which the operator may manually manipulate the first paddle (102).

Figure 3:
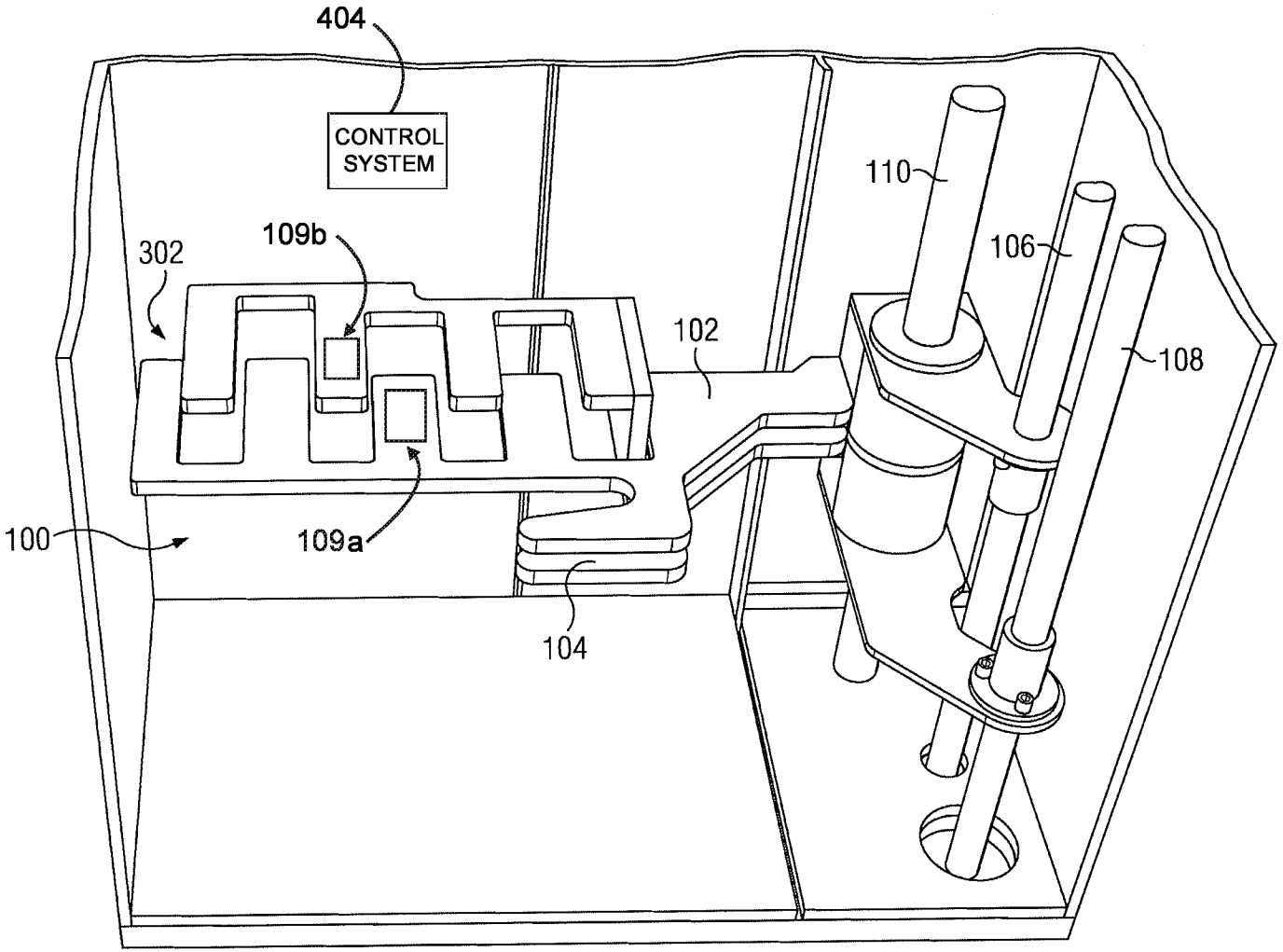
FIG. 3 is a further depiction of the embodiment in which the feeder paddle relative positioning is changed.

FIG. 3 is a further depiction of the current embodiment in which the feeder paddle relative positioning is changed. As shown, the first feeder paddle (102) is lowered such that its document surface (103) is beneath that (105) of the second paddle (104). The cutout features (302) allow the document surface (103) of the first paddle (102) move either above or below that (105) of the second paddle (104) to singularly allow either the first paddle or the second paddle to support a document stack.

Figure 4:
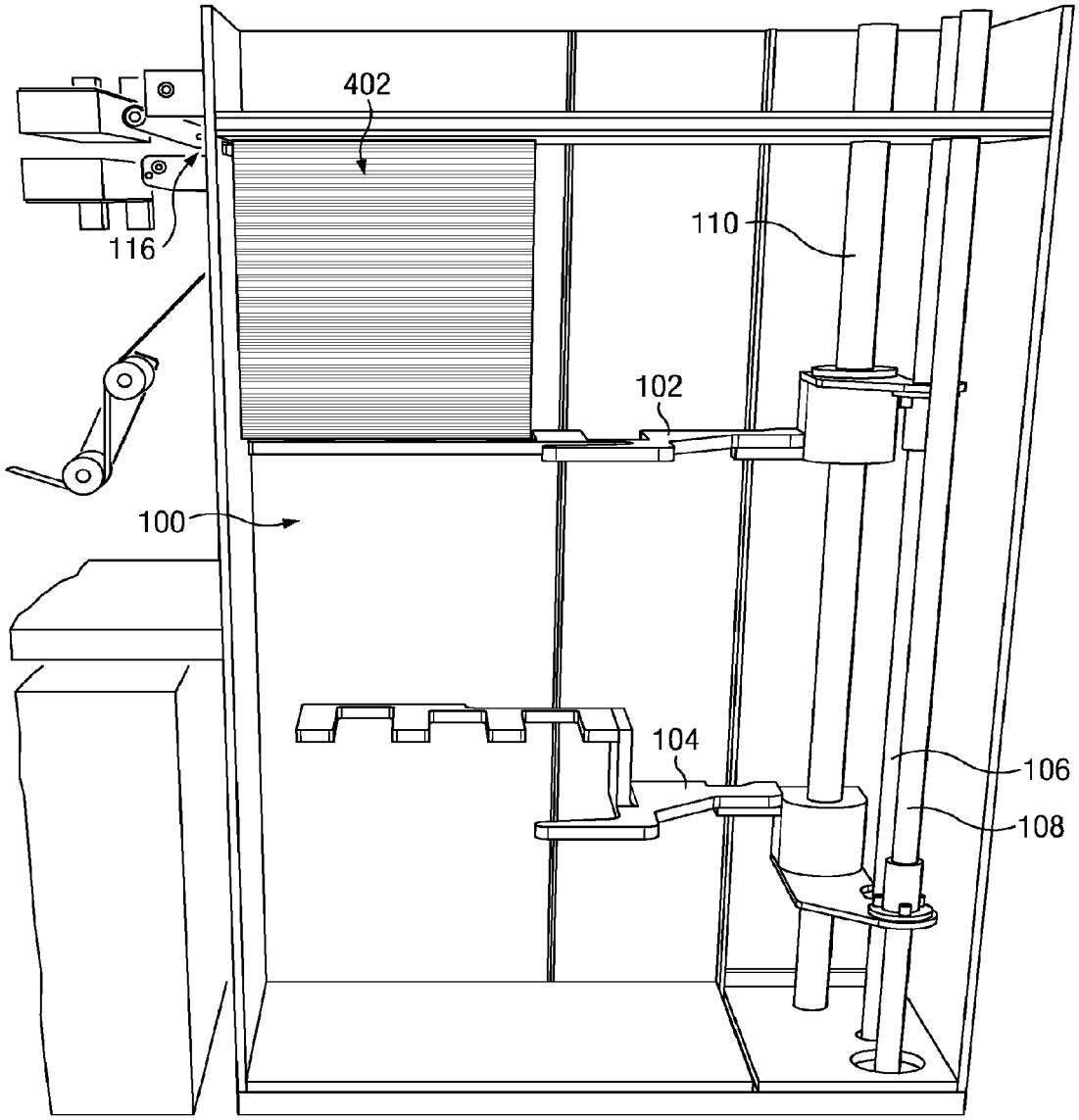
FIG. 4 is a frontal view depiction of the embodiment, further showing a first document stack placed upon a feeder paddle.

FIG. 4 is a frontal depiction of the current embodiment, further showing a first document stack (402) placed upon the first feeder paddle (102). In this embodiment the document stack (402) is being pressed against the stripper mechanism with sufficient pressure to allow the stripper mechanism to feed documents, sequentially, into the document feed path inlet (116). As the documents are stripped from the stack (402), the stack decreases in height and the first paddle (102) must translate linearly upwards along the guide rod (110). In another embodiment a pressure sensor 109a exists on the document surface of the first paddle (102), allowing pressure feedback to aid a control system (404) of the feeder mechanism to maintain consistent pressure on the document stack (402). A pressure sensor 109b may also be utilized on the document surface of the second paddle (104) to achieve the same ends.

Figure 5:
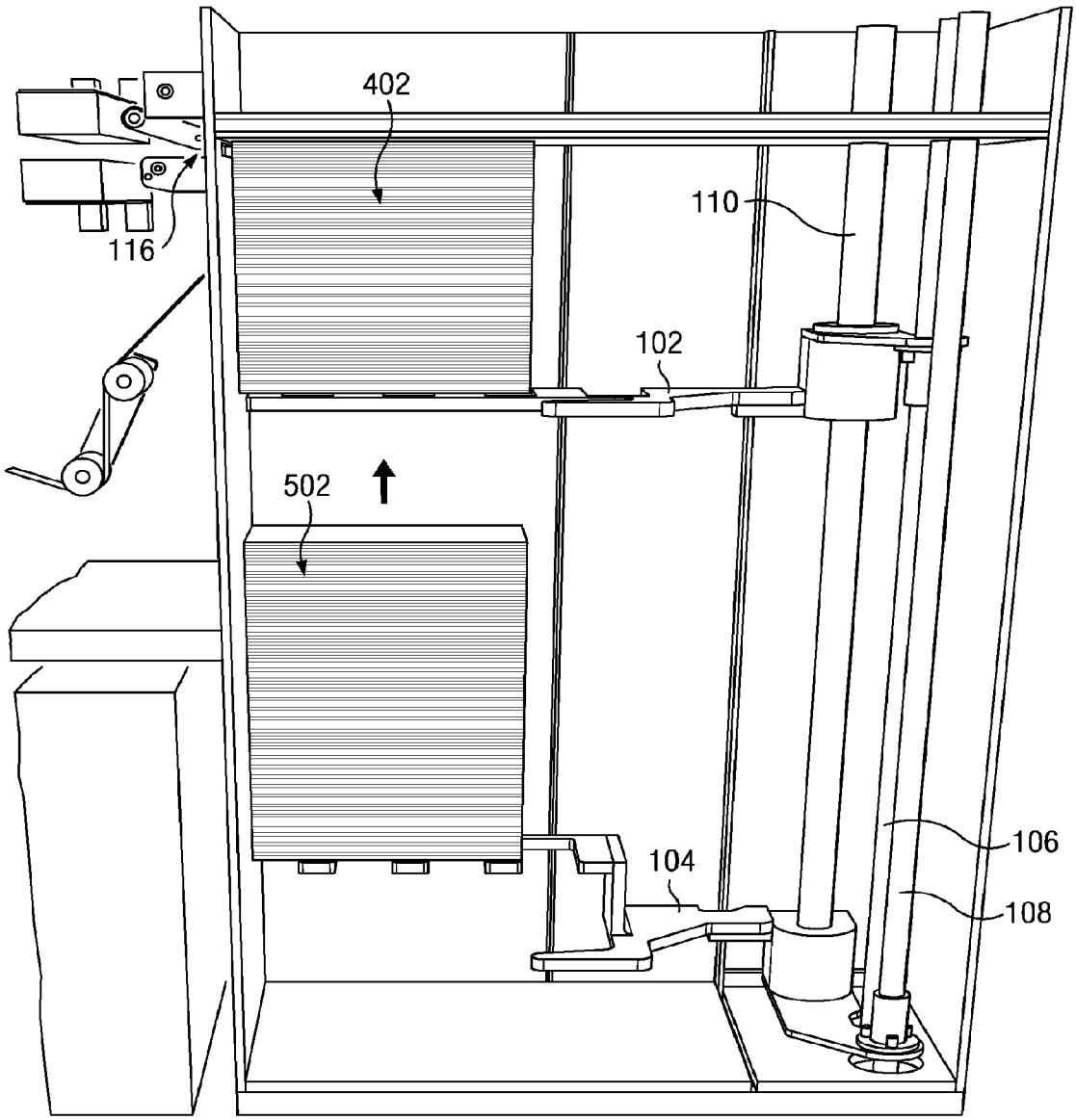
FIG. 5 is a frontal view depiction of the embodiment, further showing partial depletion of the first document stack and positioning of a second document stack for replenishment of the machine.

FIG. 5 depicts partial depletion of the first document stack (402) and positioning of a second document stack (502) for replenishment of the document processing machine. As depicted, the first paddle (102) continues to feed the first stack of documents (402) into the stripper mechanism and corresponding document path inlet (116). The second paddle (104) is shown lowered to its lowest most point within the document feed path and a second stack of documents (502) placed upon its document surface. The rotary-to-translatory device (108) is then operated to raise the second document stack (502) until this second stack contacts the bottom side of the first paddle (102).

Figure 6:
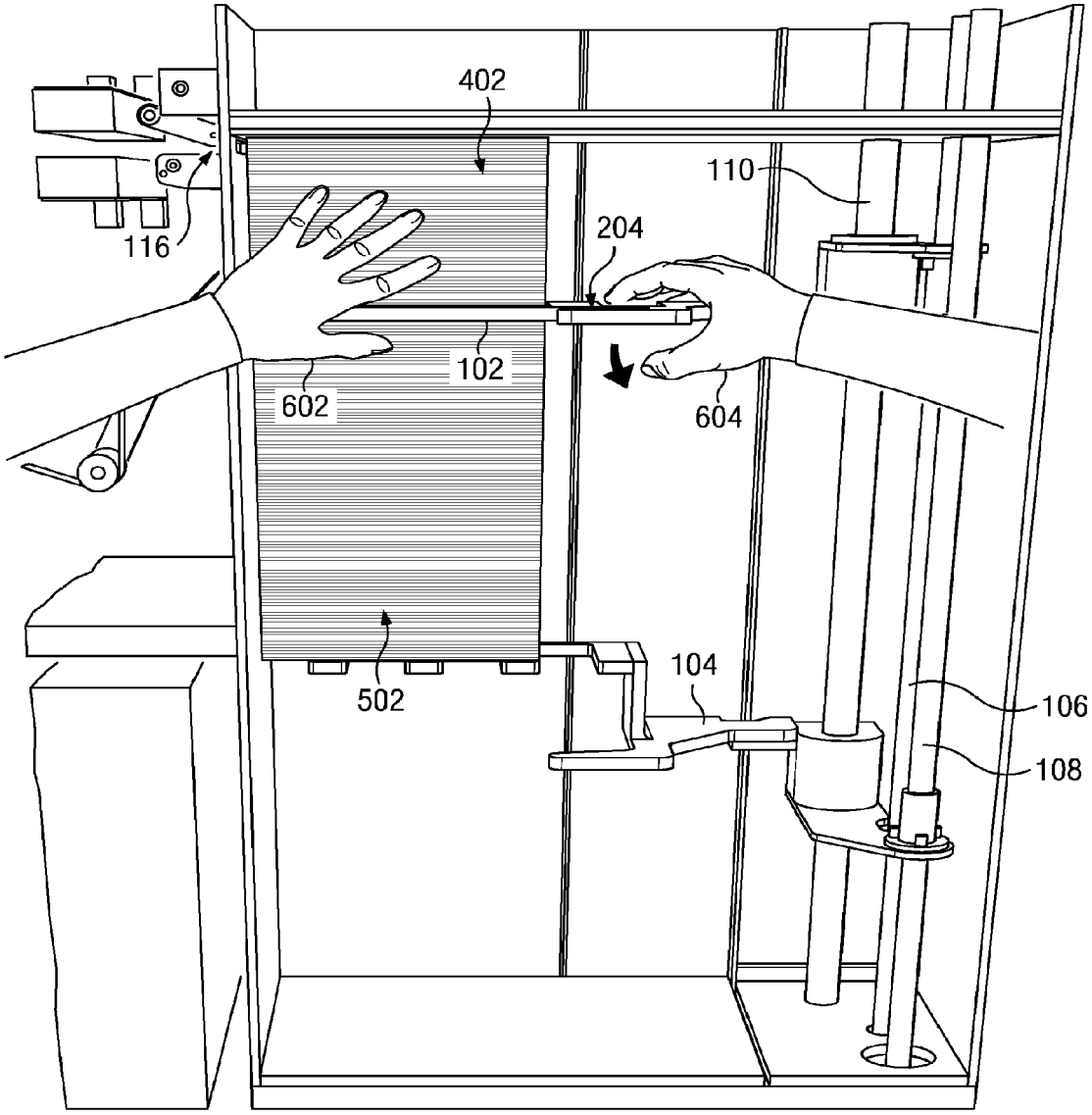
FIG. 6 is a frontal view depiction of the embodiment, further showing the first and second document stacks in position as the machine operator manipulates one of the feeder paddles.
Figure 7:
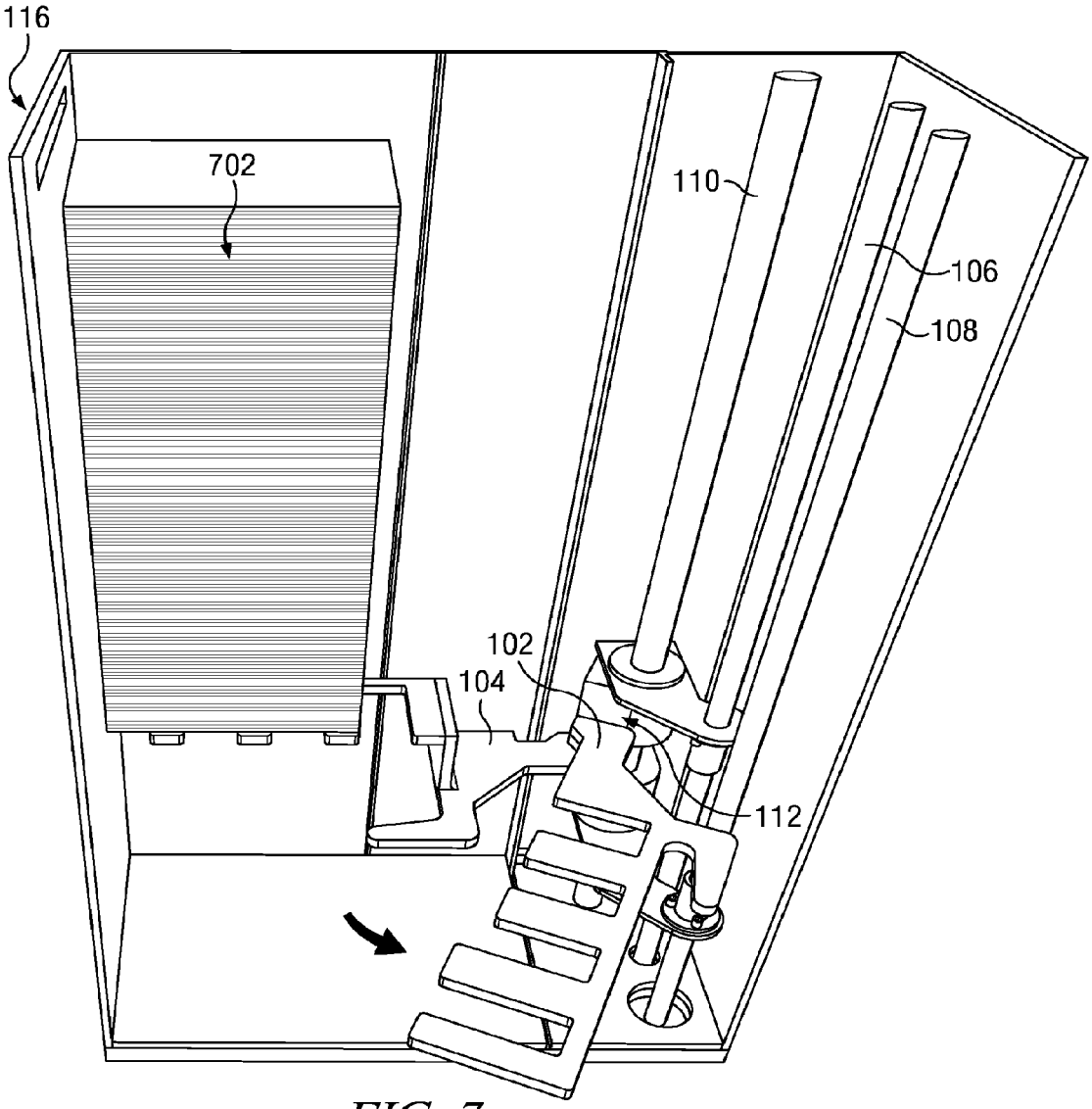
FIG. 7 is a downward view depiction of the embodiment, further showing action of the manipulated feeder paddle.

Once the second document stack (502) is raised and contacting the bottom surface of the first paddle (102), pressure is placed upon the bottom surface to sandwich the first paddle between the first and second document stacks. FIG. 6 depicts this situation. Once sufficient pressure is applied, the operator places a hand on the first stack (402) and second stack (502) as shown to prevent outward movement of the documents. As the operator holds the documents, the free hand (604) may grasp the paddle handle (204) and the paddle pulled from between the document stacks and outward from the document feed path. As now shown in FIG. 7, the first and second stacks are joined, creating a third contiguous stack (702) that is being fed into the stripper mechanism by the second paddle (104). The first paddle (102) is clear of the document stack by rotating outward on its axis (112) and is translated downwards towards the second paddle (104).

Figure 8:
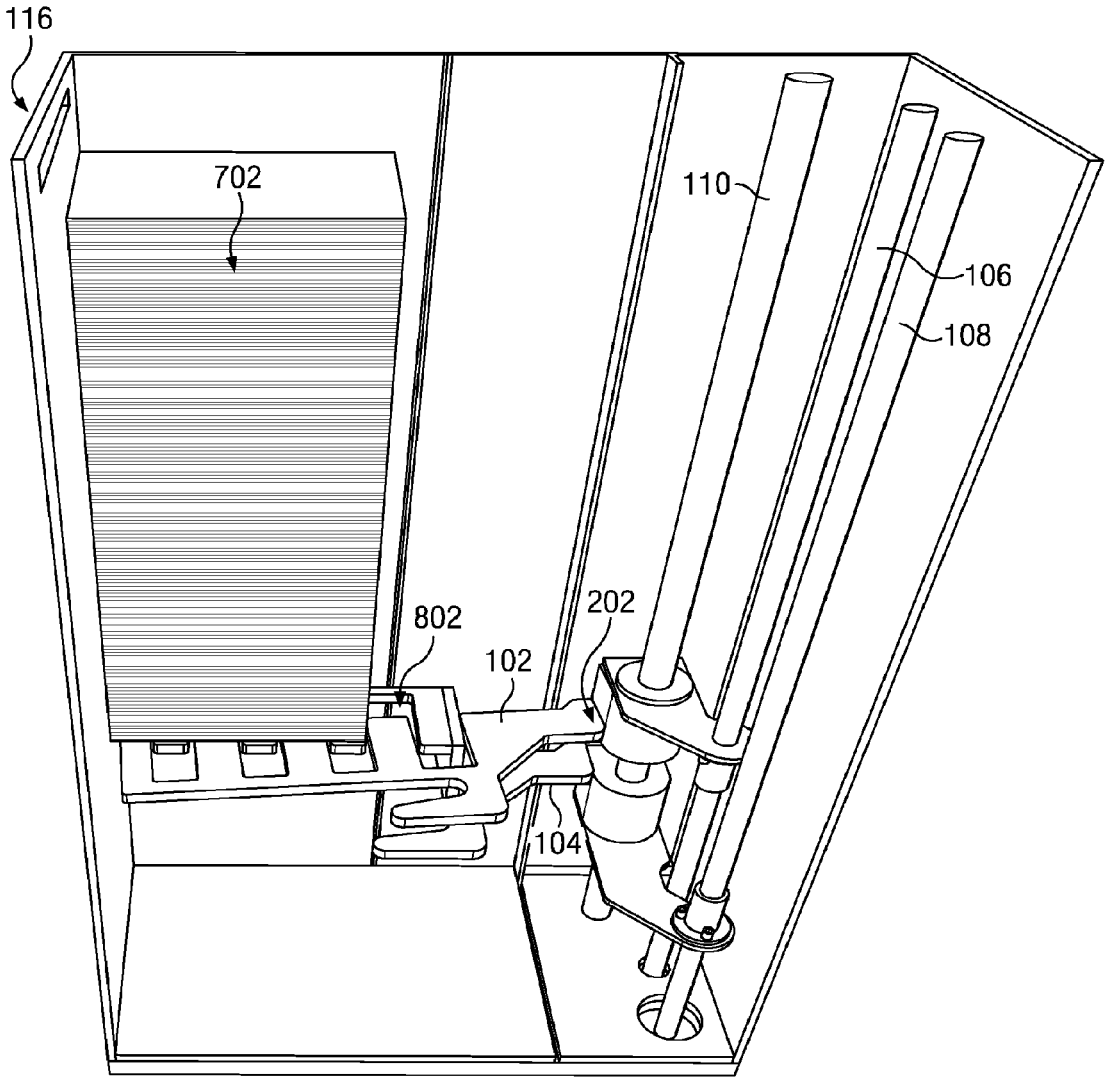
FIG. 8 is a downward view depiction of the embodiment, further showing action of the manipulated feeder paddle as it is repositioned beneath the resulting contiguous stack.
Figure 9:
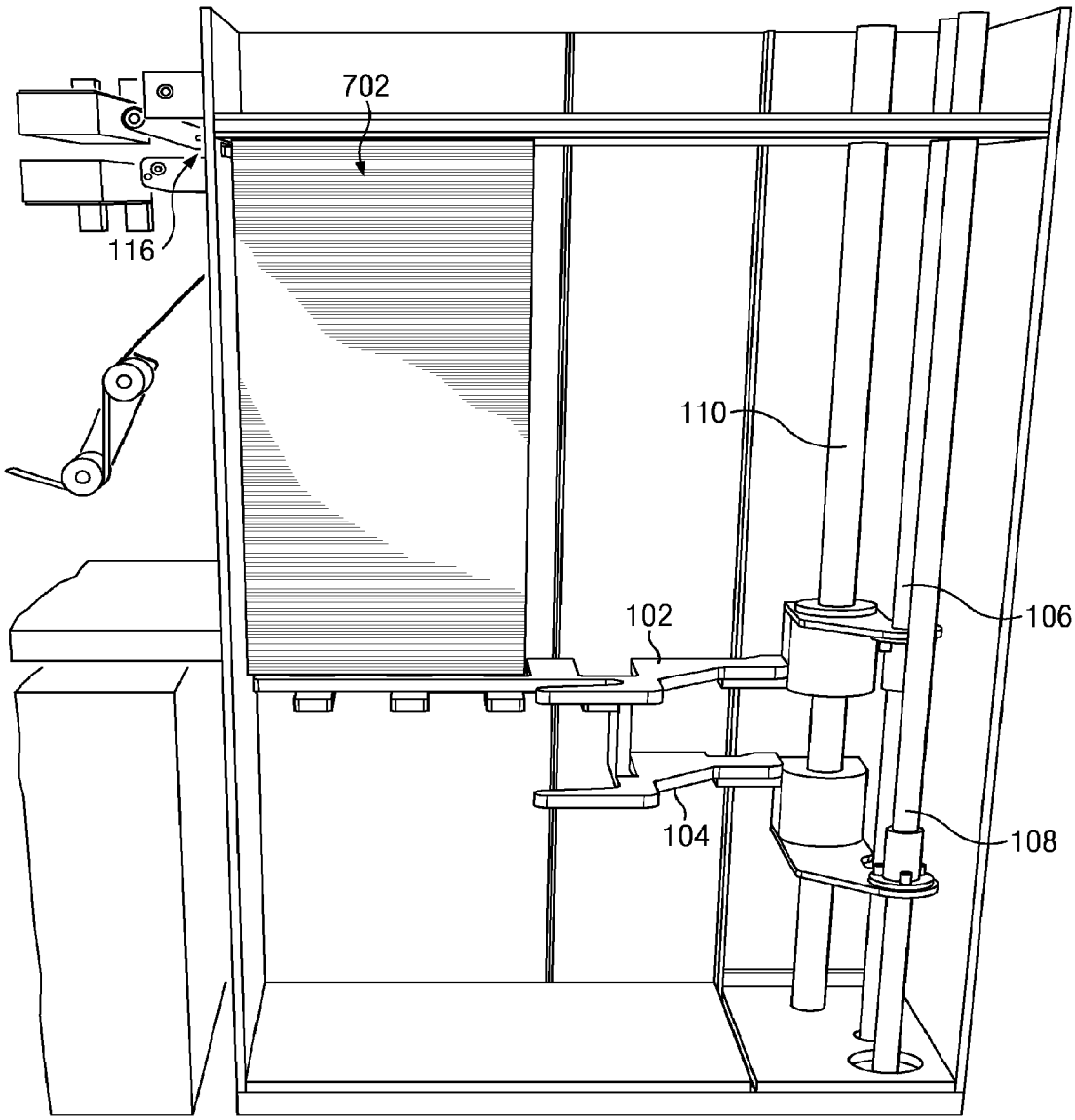
FIG. 9 is a frontal view depiction of the embodiment showing feeding of the resulting contiguous stack.
Figure 10:
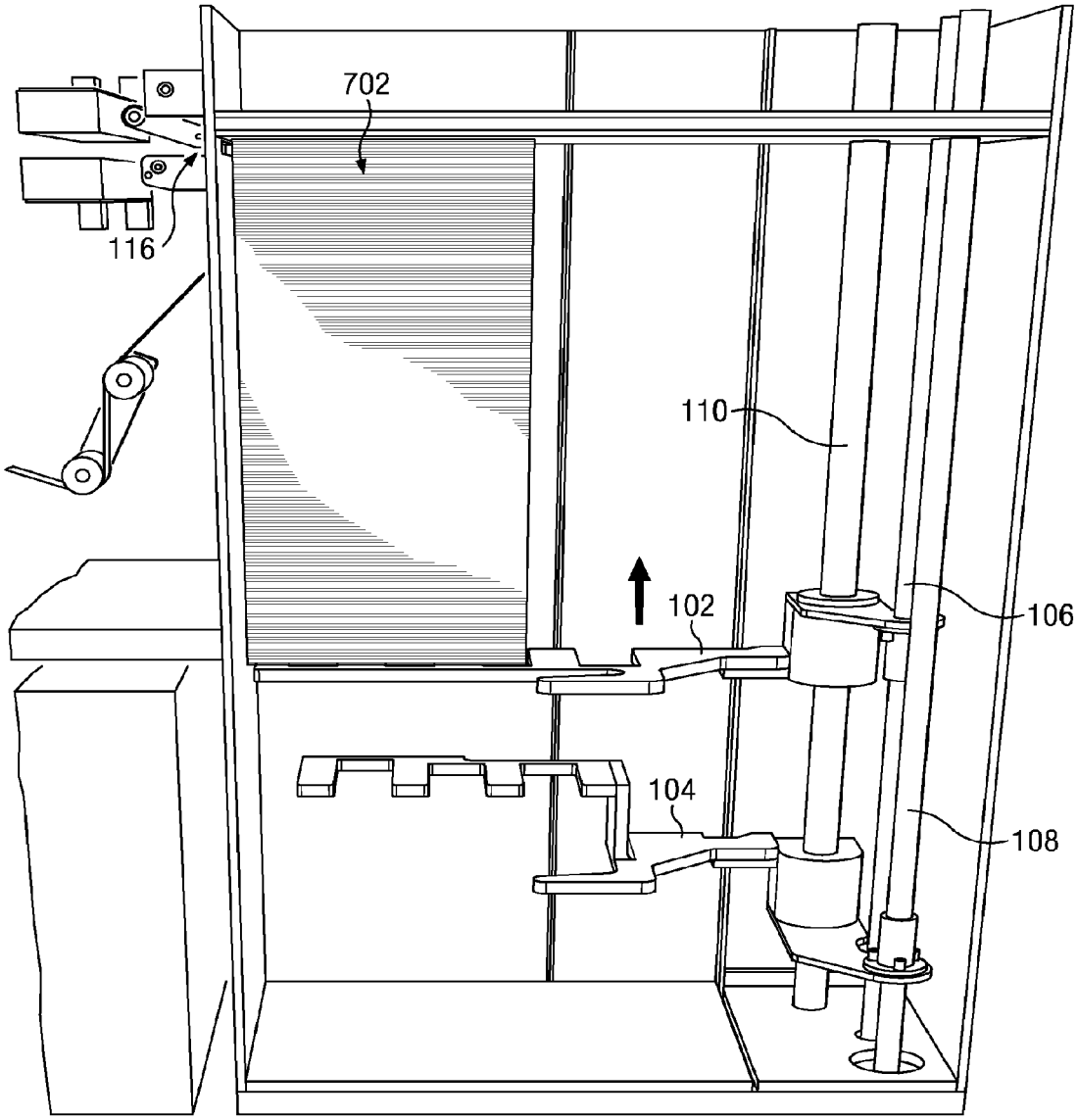
FIG. 10 is a frontal view depiction of the embodiment showing the feeder paddle being positioned to accept another replenishment document stack.

Once the first paddle (102) is lowered such that its document surface is below that of the second paddle (104), it may be moved into position to takeover feeding of the contiguous third stack (702). FIG. 8 depicts this embodiment, further showing action of the manipulated feeder paddle (102) as it is repositioned beneath the resulting contiguous stack (702) such that he complimentary cutout features (802) are reengaged. Once the first paddle (102) is in position beneath the third stack (702), it may be raised to regain control over the stack (702) from the second paddle (104). This is depicted in FIG. 9. Document feeding continues with the first feeder paddle (102) and the second paddle (104) may be lowered to repeat the document replenishment process with a new stack of documents.

The invention may be embodied in other specific forms without departing from the spirit or essential characteristics thereof. The present embodiments are therefore to be considered in all respects as illustrative and not restrictive. Accordingly, the scope of the invention is established by the appended claims rather than by the foregoing description. All changes which come within the meaning and range of equivalency of the claims are therefore intended to be embraced therein. Further, the recitation of method steps does not denote a particular sequence for execution of the steps. Such method steps may therefore be performed in a sequence other than that recited unless the particular claim expressly states otherwise.

I claim:

1. A feeder apparatus, the apparatus comprising:

a first feeder paddle and a second feeder paddle capable of linear translatory motion within a document feed path of a document processing machine, the first feeder paddle being further outwardly displaceable with respect to the document feed path, each paddle having a document surface for supporting a stack of documents as the documents are translated within the document feed path;

a plurality of cutout features within the first feeder paddle's document surface and the second feeder paddle's document surface that allow either the first feeder paddle document surface or the second feeder paddle document surface to singularly support the stack of documents, and that allow both the first and second feeder paddle document surfaces to simultaneously occupy a common level plane within the document feed path;

a first sensing device located on the first feeder paddle and a second sensing device located on the second feeder paddle for detecting pressure applied by the first feeder paddle and the second feeder paddle on the stack of documents; and a control system for maintaining consistent pressure on the stack of documents based on the pressure detected by the first and second sensing devices.

2. The apparatus of claim 1 further comprising:

a rotary-to-translatory mechanical linkage device mechanically coupled with the first feeder paddle or the second feeder paddle, wherein the linkage device provides for linear translatory motion of the mechanically coupled first feeder paddle or second feeder paddle within the document feed path.

3. The apparatus of claim 1 wherein the first feeder paddle's cutout features compliment the second feeder paddle's cutout features.

4. The apparatus of claim 1, wherein the first feeder paddle's cutout features comprise rectangular extensions originating from a common edge of the first feeder paddle and interlace with complimentary rectangular extensions on the second feeder paddle.

5. The apparatus of claim 1 wherein the first paddle comprises a handle device to allow a document processing machine operator to physically rotate the first feeder paddle such that it swings outward from the document feed path.

6. A method for feeding documents into a document feed path of a document processing machine, the method steps comprising:

using a first feeder paddle having a document surface for supporting a stack of documents to feed a first stack of documents within the document feed path of a document processing machine;

using a second feeder paddle having a document surface for supporting a stack of documents to add a second stack of documents to the first stack of documents without interrupting the feeding of the first stack of documents, wherein the combined first stack of documents and the second stack of documents become a contiguous third stack of documents;

using the first feeder paddle to feed the third stack of documents within the document feed path;

using a first sensing device located on the first feeder paddle and a second sensing device located on the second feeder paddle to detect pressure applied by the first feeder paddle and the second feeder paddle on the stack of documents; and using a control system to maintain consistent pressure on the stack of documents based on the pressure detected by the first and second sensing devices.

7. The method of claim 6, the method steps further comprising:

sandwiching the first feeder paddle between the first and second stacks of documents by applying pressure to the first feeder paddle with the second stack of documents; and removing the first feeder paddle from between the first and second stacks of documents without interrupting the feeding of the first stack of documents into the document feed path.

8. The method of claim 7 wherein the first feeder paddle is manually removed from between the first and second stacks of documents by an operator.

9. The method of claim 7, the method steps further comprising:

moving the first feeder paddle outward a sufficient distance from the document feed path such that the first feeder paddle no longer contacts the third stack of documents;

translating the first feeder paddle to a position such that the first feeder paddle document surface is beneath the second feeder paddle document surface;

moving the first feeder paddle inward into the document feed path such that the first feeder paddle document surface is positioned beneath the third stack of documents; and translating the first feeder paddle such that the first feeder paddle document surface contacts the third stack of documents.

10. The method of claim 9 wherein the first feeder paddle is moved manually by an operator.

11. The method of claim 9, the method steps further comprising:

translating the second feeder paddle in a direction opposite that of a feeding direction of the third stack of documents in the document feed path;

placing a fourth stack of documents onto the second feeder paddle; and using the second feeder paddle to add the fourth stack of documents to the third stack of documents without interrupting the feeding of the third stack of documents, wherein the combined third stack of documents and the fourth stack of documents become a contiguous fifth stack of documents.

* * * * *